US006932590B2

(12) United States Patent
Geus et al.

(10) Patent No.: US 6,932,590 B2
(45) **Date of Patent: *Aug. 23, 2005**

(54) APPARATUS FOR THE CONTINUOUS PRODUCTION OF SPUN-BOND WEB

(75) Inventors: Hans Georg Geus, Niederkassel (DE); Detlef Frey, Niederkassel (DE); Peter Schlag, Troisdorf (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 184 days.

This patent is subject to a terminal disclaimer.

(21) Appl. No.: 10/375,895

(22) Filed: Feb. 27, 2003

(65) Prior Publication Data

US 2003/0161904 A1 Aug. 28, 2003

(30) Foreign Application Priority Data

Feb. 28, 2002 (EP) ..... 02004614

(51) Int. Cl.[7] ..... D01D 5/092

(52) U.S. Cl. ..... 425/66; 425/72.2; 425/382.2; 156/441

(58) Field of Search ..... 425/66, 72.2, 382.2, 425/DIG. 17; 264/210.8, 211.14, 211.12, 103, DIG. 75; 156/441, 167, 166, 180, 181

(56) References Cited

U.S. PATENT DOCUMENTS

| | | | | | |
|---|---|---|---|---|---|
| 4,583,267 | A | * | 4/1986 | Fehrer | 19/99 |
| 5,460,500 | A | * | 10/1995 | Geus et al. | 425/66 |
| 5,800,840 | A | * | 9/1998 | Geus et al. | 425/7 |
| 5,820,888 | A | * | 10/1998 | Geus et al. | 425/66 |
| 6,499,982 | B2 | * | 12/2002 | Allen et al. | 425/83.1 |
| 2004/0009251 | A1 | * | 1/2004 | Becker et al. | 425/72.2 |

* cited by examiner

*Primary Examiner*—Joseph S. Del Sole
(74) *Attorney, Agent, or Firm*—Herbert Dubno

(57) ABSTRACT

An apparatus for producing spun-bond webs has, beneath the receiving belt, a suction unit having at least two suction zones including a primary suction zone and at least one other suction zone, the primary suction zone receiving most of the filaments from an aerodynamic stretching unit below a spinneret. The suction speeds in the two zones can be adjusted independently of one another. Preferably three such zones are provided in succession in the direction of displacement of the perforated belt.

11 Claims, 4 Drawing Sheets

APPARATUS FOR THE CONTINUOUS PRODUCTION OF SPUN-BOND WEB

FIELD OF THE INVENTION

The present invention relates to an apparatus for the continuous production of spun-bond web and, more particularly, to the collection of the aerodynamically stretched filaments to form that web.

BACKGROUND OF THE INVENTION

In the production of a spun-bond web, filaments are extruded from a spinneret, are cooled and are aerodynamically stretched beneath the spinneret and are deposited upon a continuously movable collection or deposit belt which is foraminous or in the form of a screen so that the jumble of filaments can form a mat or fleece which passes beneath a pressing roller or between a pair of pressing rollers as the web is carried along in the direction of displacement of the continuously movable belt. Beneath the belt or screen a suction device is provided for drawing air through the belt to facilitate the deposition of the filaments on the belt to form the web.

As a practical matter, the filaments emerge from orifices of the spinneret and initially traverse a cooling chamber or passage in which those filaments are subjected to contact with process air for the cooling of the filaments before passing into a stretching unit which has, at its lower end or outlet side, a drafting channel exercising the aerodynamic entrainment upon the filaments to stretch the latter.

Then, preferably, the filaments pass via at least one diffuser forming part of a tiering unit which layers the filaments onto the screen.

The screen itself is an endless circulating outlet and the suction device below it draws the air through the belt and reliably pulls the filaments onto the belt and reliably holds the fleece which is formed against the belt. Downstream of the collection zone, the pressing rollers are provided to press the web against the belt or between the rollers located above the web and below the belt where a pair of such rollers is provided.

In general, such apparatus has been found to be highly effective with respect to the production of spun bond, but to permit improvement especially with respect to the uniformity of the deposition of the filaments and the formation of the fleece. In some cases with the conventional apparatus, nonhomogeneities with respect to filament density and the fleece mesh width or porosity can arise and can lead to variations in the properties of the web such as strength, elongation, permeability or the like.

OBJECTS OF THE INVENTION

It is, therefore, the principal object of the present invention to provide an apparatus for the production of spun-bond web which will be free from the drawbacks of the earlier systems as outlined above.

Another object of this invention is to provide an apparatus for the continuous production of spun bond from aerodynamically stretched filaments which can effect the deposition of the spun fleece as uniformly as possible and ensure a maximum uniformity in the arrangement of the filaments in the spun-bond web.

Still another object of the invention is to provide an apparatus for the purposes described which will minimize the irregularities in the properties of the spun bond which is produced.

SUMMARY OF THE INVENTION

These objects and others which will become apparent hereinafter are attained, in accordance with the invention, in an apparatus which comprises:

a spinneret for producing a multiplicity of descending thermoplastic synthetic resin filaments;

a device below the spinneret and receiving the multiplicity of descending thermoplastic synthetic resin filaments for aerodynamically stretching same;

a continuously movable collecting foraminous belt displaceable longitudinally in a web-producing direction below the device for receiving the filaments to produce a spun-bond web therefrom; and at least two mutually independently controllable suction zones beneath the belt for drawing air therethrough and in succession in the direction, including a primary suction zone at which a greater part of the filaments are drawn onto the belt and at least one other suction zone.

The apparatus of the invention thus has, in the direction of the displacement of the foraminous belt at least two independent suction zones located one after the other or in succession below that belt, one of these zones being a main or primary suction zone at which most of the filaments deposit. According to the invention, the suction velocity in this main zone and in at least one other suction zone can be adjusted independently of one another.

A collection or deposit zone or a suction zone in the sense of the invention, signifies the region of the belt at which the filaments are collected thereon and the main zone, therefore, is that region at which most of the filaments are collected. The suction device has at least one suction blower.

According to the invention, in the suction zone the suction speeds, i.e. the speeds with which air is drawn through the belt in these zones can be set or controllable independently from one another and thus there are at least two such zones having independently adjustable suction speeds as measured in meters per second (m/s).

In a preferred embodiment of the invention, three suction zones which have the suction speeds independently controllable, are provided in succession beneath the perforated belt, including a first suction zone upstream of the main suction zone and a second suction zone downstream of the main suction zone with respect to the direction of displacement of the belt, i.e. the transport direction of the web. The suction speeds in all three zones are adjustable or settable independently of one another. The suction powers in the three suction zones likewise is settable, adjustable or controllable independently from one another.

According to a feature of the invention, the suction speed in the main suction zone is higher than that in the first and/or second suction zones. The suction speed in the main suction zone is preferably at least three times the suction speeds in the first and/or second zones and even more preferably four times higher.

In yet another highly preferred feature of the invention the suction speed in the main suction zone is at least five times that in the first and/or second zones. The suction speed in the first and/or second zones can lie between 1 and 6 m/s, preferably between 2 and 5 m/s, while the suction speed in the main zone is 25 to 35 m/s and preferably 27 to 33 m/s. The preferred speed in the main zone is 30 m/s or approximately 30 m/s.

The invention is based upon our discovery that in the first suction zone the air flow through the screen has flow vectors at the upstream boundary of the main suction zone which are uniformly orthogonal to the screen surface so that in the subsequent main suction zone the filaments can deposit on the screen without irregularities resulting from nonuniform air flow at the upstream boundary. If there is some deposition of the filaments in this first air stream suction zone, that deposition is also substantially uniform and contributes to a reliable and homogeneous formation of the spun-bond fleece. In the adjacent main suction zone, most of the fleece formations occur and this deposit of the filaments is no longer influenced by disturbances at the upstream side. The most reliable deposit of the filaments is obtained when the suction speed in the main collection zone is significantly greater than the suction speed in the first suction zone.

The suction speed in the main suction zone is also as has been noted, significantly greater than the suction speed in the second suction zone in which the suction serves primarily to ensure reliable retention of the fleece against the belt until the fleece has been compacted and stabilized by the bonding of the filaments to form the web.

In a preferred embodiment of the invention at least a third of the length of the second suction zone, as measured in the direction of displacement of the perforated belt, lies upstream of the compressing roller or roller pair. More preferably, at least half the length of the second segment zone lies upstream of the compression rollers. This ensures a particularly reliable transport of the deposited fleece to the pressing rollers. This configuration has been found to be especially valuable in ensuring the formation of a uniform web.

The length of the first suction zone is, however, preferably shorter than the corresponding lengths of the main suction zone. Advantageously the length of the first suction zone is also shorter than the length of the second suction zone as measured in the direction of displacement of the web.

Each of the suction zones can be provided with a separate suction blower individual thereto. According to another feature of the invention, however, a single suction blower can be provided for all of the zones and each zone can be connected to that single suction blower by a respective suction speed setting element and/or throttle. Thus, while the single suction blower can be provided for the first suction zone, the main suction zone and the second suction zone, the suction condition and especially the respective suction speeds of each of the three zones can be individually controlled by the respective valves.

According to still another feature of the invention, the first suction zone is separated from the main suction zone by a first wall while the main suction zone is separated from the second suction zone by a second wall, preferably of sheet metal. The first and second walls may define a nozzle contour for the main suction zone. A nozzle contour is defined, for the purposes of the invention, as presenting an initial converging segment, a constriction and a subsequent diverging or diffuser segment to the air flow through the main suction zone. The suction zones, of course, extend across the width of the belt.

The constriction as defined by the shapes of the two walls means that the distance between the first and second walls at this location has a minimum. The two walls are preferably symmetrical with respect to a median plane perpendicular to the belt and to the direction of displacement thereof.

In accordance with a preferred feature of the invention the spacing between these walls can be varied or adjusted. In other words the width of the constriction in the main section zone is adjustable. Preferably the region below the constriction has an adjustable spacing of the wall and the region above the constriction (and immediately below the belt), has an adjustable walls spacing. The adjustability allows setting of the suction conditions in the main zone with a high degree of variability and thus allows optimization of those suction conditions for the particular properties of the spun bond web desired.

The spinneret of the apparatus is preferably provided above a cooling chamber or passage which communicates with a process air supplied to zones following one another in the direction of travel of the filaments. For example, the air supply chamber which communicates with the cooling passage through holes in the walls thereof, can be subdivided into at least two vertically separated chamber sections or compartments. Preferably the upper or first of these compartments can supply process air at one temperature while the next or second compartment or chamber section below it can supply process air at a second temperature which can be lower than the first. The temperature of the air in the first compartment can be say 18 to 70° C. while the temperature of the air in the second compartment can be 18° C. to 35° C.

While the air in the first compartment is preferably of a higher temperature, as noted, than the air in the second compartment, the reverse is also possible. Each of the compartments can have at least one blower for supplying the process air and the blowers can be controllable to adjust the volume rates of flow of the air from each of the compartments into the cooling passage.

At the lower end of the stretching unit, a drafting channel can be provided for accelerating the flow of process air therethrough and thereby applying an additional pull by aerodynamic entrainment to the filaments.

In a preferred embodiment of the invention, the stretching unit delivers the descending curtain of filaments to the depositing or tiering unit which has at least one diffuser. The tiering unit of the invention is of special importance since it contributes to the uniformity of the spun-bond web which is produced. Preferably the tiering unit is multistaged in the sense that it has at least two diffusers, namely, a first diffuser opening into a second diffuser. Here the term "diffuser" is intended to mean a structure with a constriction or narrowest portion below which the flow expands or widens out.

In the preferred embodiment, between the first and second diffusers, an air gap is provided through which ambient air, also referred to as secondary air, can be drawn into the path of the filaments. In the first diffuser there is a reduction in the air velocity with which the filaments are entrained from the drafting unit and a significant recovery of the pressure. Advantageously, the opening angle of the divergent lower region of the first diffuser is adjustable in a stepless manner and for this purpose the wall of the diffuser can be swingable like flaps.

Because of the high output of the first diffuser stage, there is a Venturi action drawing the secondary air into the gap and the width of this gap may be adjustable in accordance with another feature of the invention. The volume rate of flow of secondary air in through the gap may amount to 30% of the process air flow from the first diffuser into the second diffuser.

Advantageously, the height of the second diffuser is adjustable, preferably also steplessly. The divergent angle of the second diffuser may also be steplessly adjustable.

It is important for the purposes of the invention that the two diffusers provide an effective aerodynamic decoupling between the filament forming and stretching part of the apparatus and the deposition part thereof. This has been found to help in eliminating the problems mentioned above and hitherto encountered.

The apparatus of the invention thus results in a highly uniform formation of the filament fleece and a highly homogeneous spun-bond web. The detrimental effects mentioned previously no longer appear to effect the formation of the web or the manner in which the filaments deposit upon the screen. The result is that both the fleece and the web can be visually seen to be of higher quality than has been the case heretofore and inhomogeneities as to strength, elongation and permeability are eliminated.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
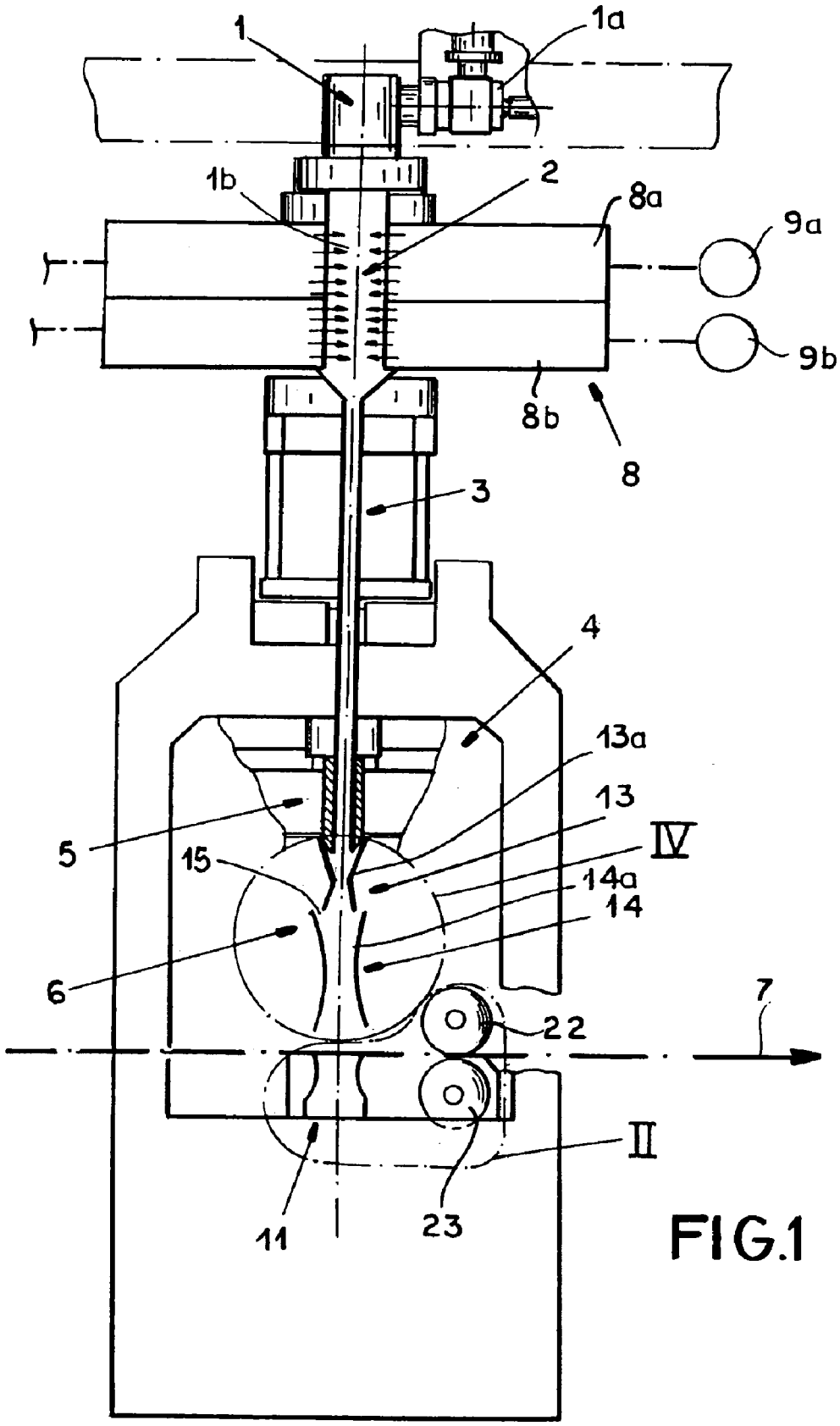
FIG. 1 is a vertical section through an apparatus in accordance with the invention.

The drawing shows an apparatus for the continuous production of a spun-bond web from aerodynamically stretched filaments from a thermoplastic synthetic resin (plastic).

The apparatus (FIG. 1) comprises a spinneret 1 supplied by an extruder 1*a* for the synthetic resin, a cooling chamber 2 below the extruder and forming a passage for the curtain of filaments 1*b* descending from that extruder. The walls of the passage 2 are perforated and communicate with respective air chambers 8*a* and 8*b* of an air chamber system 8 delivering cooling air to the filaments as represented by the arrows. The cooling passage 2 is connected by an intermediate passage 3 with a drawing unit 4 through which the process air delivered by blowers 9*a* and 9*b* entrain the filaments so that they are stretching as they pass through the intermediate passage 3 and the drawing unit 4.

The lower part of the drawing unit 4 is formed with a drafting channel 5 in which the filaments are pulled downwardly to enter the tiering unit 6 which deposits the filament in overlapping layers and strands on a perforated or foraminous belt 7 continuously displaced beneath the tiering unit 6 and forming a collecting screen for the filaments. The layer of filaments then passes between a pair of compression rollers 22, 23, to press the filament strands and turns into contact with one another and effect bonding thereof in a spun-bond product.

Below the belt 7, a suction system represented generally at 11 is provided to assist in drawing the filaments onto the belt by entrainment of air through the belt by suction.

In FIG. 1, it has been shown that the compartments 8*a* and 8*b* or sections of the air chamber 8 adjacent the cooling passage 2 can be supplied with process air through different blowers 9*a* and 9*b*. According to an aspect of the invention it is important for the compartments 8*a* and 8*b* to be able to be supplied with process air at different temperatures. Thus, for example, the upper compartment 8*a* can be supplied with process air at a temperature between 18° C. and 70° C. while the lower compartment 8*b* is supplied with process air at a temperature of 18° C. to 35° C.

Preferably, the higher temperature air is supplied at the upper compartment and a lower temperature air at the lower compartment.

While we have shown that the air is supplied under a positive pressure to the compartments 8*a* and 8*b* by the blowers 9*a* and 9*b*, it is also possible for the filaments to draw air by entrainment into the cooling passage 2 from the compartments 8*a* and 8*b*. The volume flows in the compartments 8*a* and 8*b* are also controllable according to the invention in addition to the temperatures of the air admitted to each compartment.

The intermediate compartment shown in FIG. 1 converges downwardly from the cooling passage 2 to the stretching unit 4 in a wedge like configuration and 2, for example, the inlet width of the drafting channel 5.

The drafting channel 5 itself may be downwardly convergent in a wedge shaped manner.

The depositing or tiering unit 6 can comprise a first diffuser 13 at the outlet side of a constriction or nozzle 13*a* which opens into a nozzle 14*a* formed with a second diffuser. Between the first diffuser 13 and the second diffuser 14, an inlet 15 is provided for ambient air. Each diffuser or nozzle has a downwardly converging portion to the respective constriction and a divergent portion opening downwardly away from the constriction. As a consequence, each diffuser 13, 14 has a constriction between the upper convergent portion and the lower divergent portion.

In operation, the spinneret extrudes the curtain of filaments downwardly and the filaments are cooled in the passage two and stretched in passage through the intermediate passage 3 and the stretching unit 4, 5 before being deposited in overlapping loops and turns by the unit 6 on the belt. The belt carries the overlapping filaments between the rollers 22, 23 which, at the temperature of the filaments, bonds them together to produce a mat, fleece or web which is referred to here as the spun-bond web. As can be seen from FIGS. 2 and 3, the foraminous belt 7 passes over a suction unit which draws air through the belt and thus induces the fleece to collect thereon.

Figure 2:
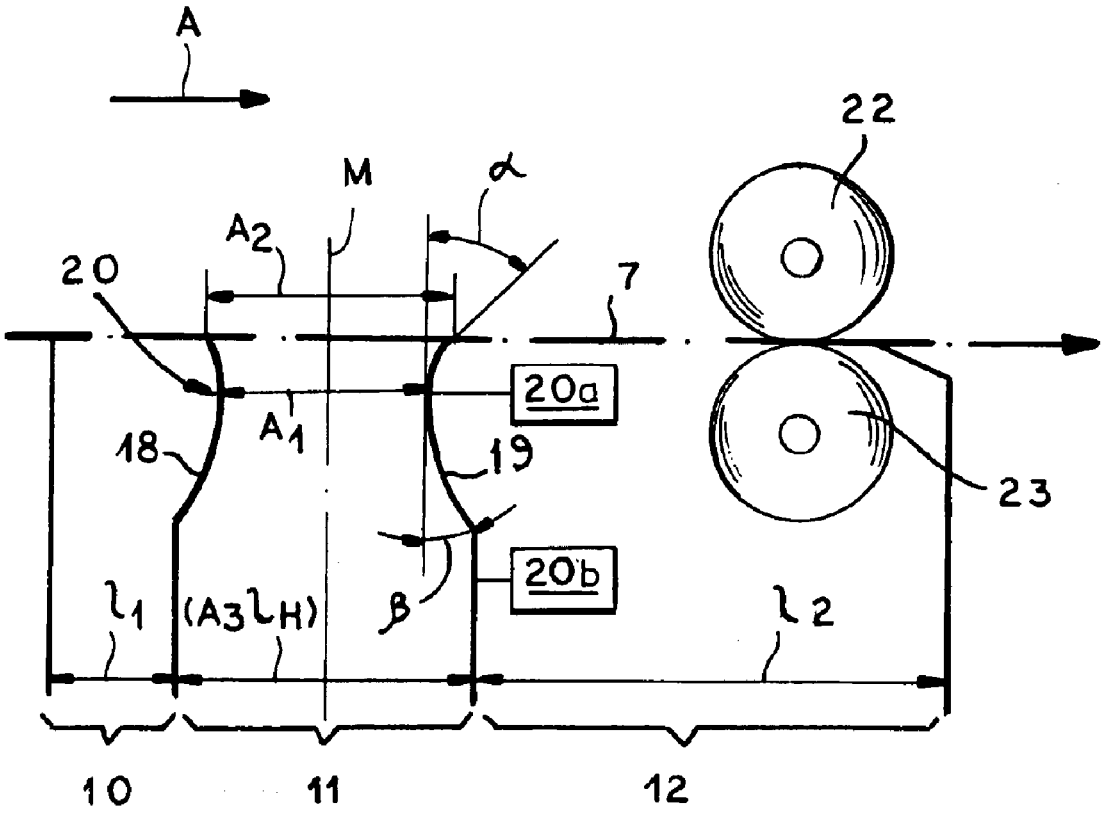
FIG. 2 is a detailed view of the region II of FIG. 1.

The suction unit as shown in FIG. 2 comprises three suction zones 10, 11, 12 below the screen belt 7 and separate from one another and arranged in succession in the direction of displacement of the belt as represented by the arrow A. A first suction zone 10 is located upstream of the main suction zone 11 while a second suction zone 11 is located downstream of the suction zone. The suction zone 11 is the region in which the greater part of the filament deposits on the belt 7.

Figure 3:
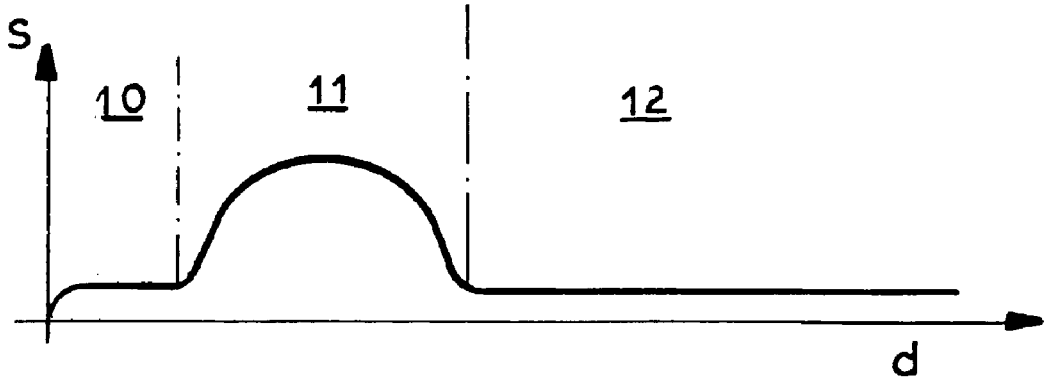
FIG. 3 is a graph of the suction velocity across the zones of the suction unit below the screen belt vs. displacement in the horizontal direction.
Figure 5:
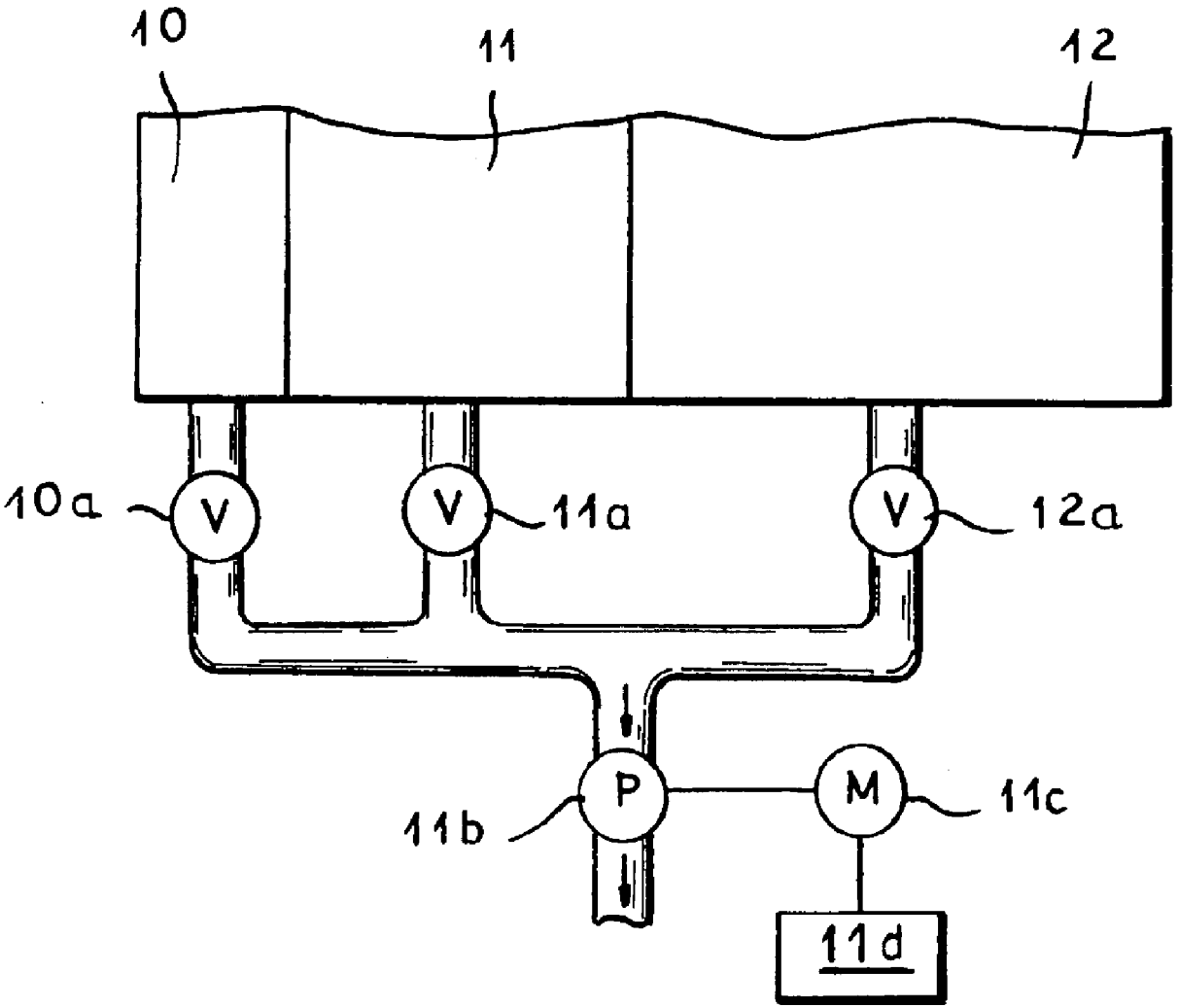
FIG. 5 is an illustration of the system for individually varying the suction powers in the succession of suction zones.

The suction speeds in the three suction zones 10, 11 and 12 can be set or adjusted independently of one another (see FIG. 5). Preferably the suction speed in the main or primary zone 11 is so set that it is greater than the suction speeds in the first zone 10 and the second zone 12. By way of example, the suction speed in the main zone 11 may be 30 m/s while the suction speed in the first and second suction zones 10 and 12 can amount to 1 to 5 m/s. In the graph of FIG. 3, in which the suction speed is plotted along the ordinate and distance along the suction device is plotted along the abscissa, it is apparent that the suction speed is significantly greater in the zone 11 than in the zones 10 and 12. The suction effect is proportional to suction speed.

Advantageously, at least a third of the length $l_2$ of the second suction zone 12, as measured in the conveyer travel direction A lies upstream of the pressing rolls 22, 23.

Advantageously, at least half of the length $l_2$ of the second suction zone 12, with respect to the displacement direction A of the foraminous belt 7 lies upstream of the pressing roll pair 22, 23.

According to a further advantageous feature of the invention, the length $l_1$ of the first suction zone 10 is less than the length $l_2$ of the second suction zone 12 and preferably also smaller than the length $l_H$ of the main suction zone 11. The lengths $l_1$, $l_2$ and $l_H$ referred to it extends of the suction zones 10, 12 and 11 in the displacement direction of the screen and are independent of the nozzle shape cross section of the main suction zone. This can be seen clearly from FIG. 2.

As is also apparent from FIG. 2, the main suction zone 11 is bounded by a first wall 18 between the first and main suction zones 10 and 11 and by a second wall 19 between the main suction zone 11 and the second zone 12. The first and second walls 18, 19, from over the width of the belt which is perpendicular to the plane of the paper, a nozzle shape contour with a constriction 20. At the constriction, the spacing $A_1$ between the two walls 18, 19 is a minimum. Preferably, the walls 18 and 19 are symmetrical with respect to a median plane M which is perpendicular to the screen belt 7 and to the direction of the displacement A.

In a preferred embodiment of the invention, the spacing $A_1$ between the two walls 18 and 19 is adjustable at the constriction 20, e.g. via the controller 20*a* and above this controller. In other words, the constriction is adjustable. The spacing $A_3$ of the walls below the constriction is adjustable via the controller $\mathbf{20}_b$ as well. The space $A_3$ corresponds to the length $l_h$ of the main suction region 11 mentioned previously. The adjustable spacing above the constriction has been represented at $A_2$. Because of the adjustability of the walls 18, 19 the angles $\alpha$ and $\beta$ formed by the walls with the vertical is adjustable in a stepless manner. The angle $\alpha$ is preferably adjustable in a range between 0° and 10° and the angle $\beta$ is adjustable in a range between 10° and 20°.

Figure 4:
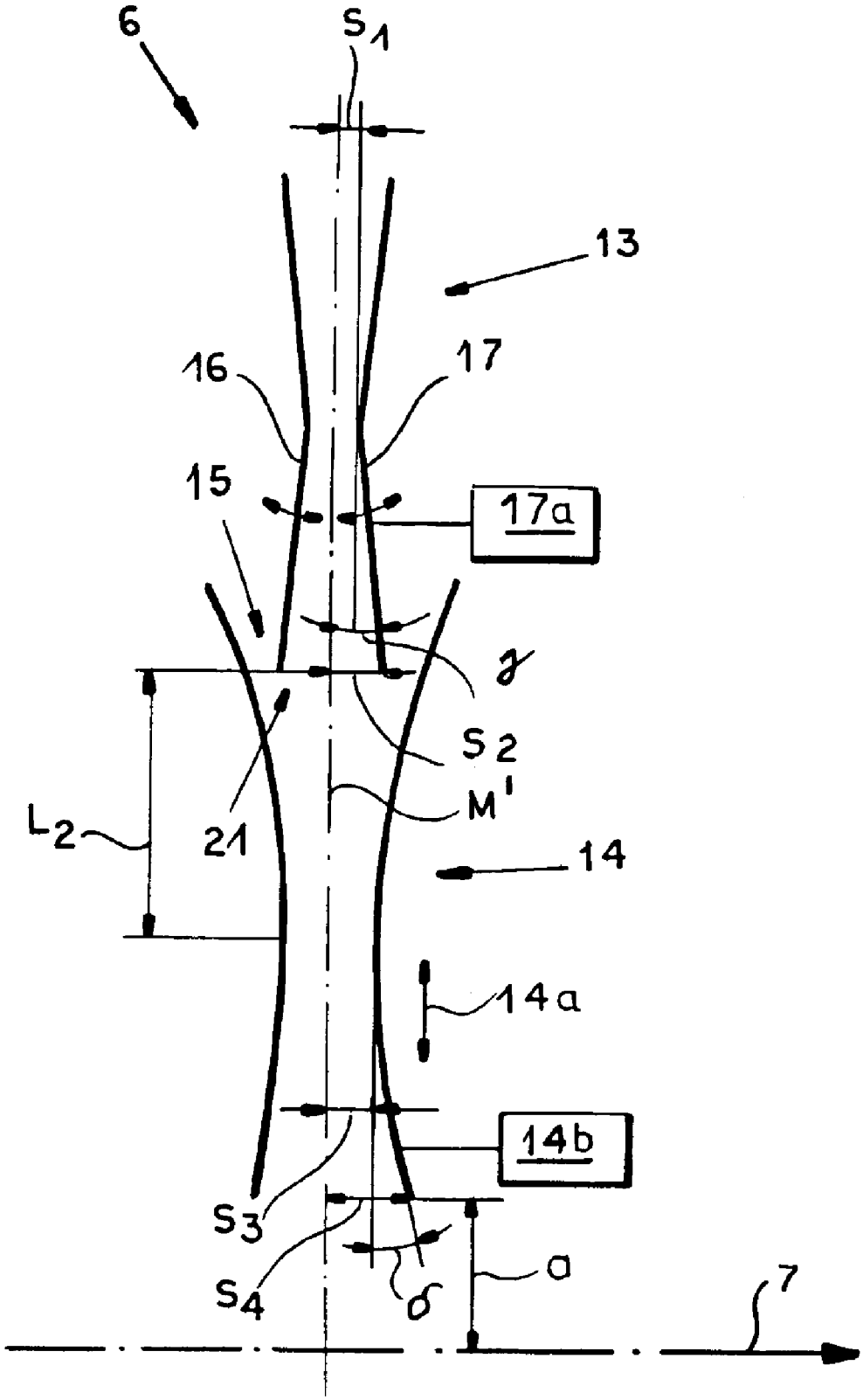
FIG. 4 is a detail of the region IV of FIG. 1.

Of special significance for the purposes of the invention is the tiering or deposition unit which is provided between the drafting channel 5 and the perforated belt 7*a* and has been indicated at 6 in FIGS. 1 and 4. The tiering unit 6 is comprised of a first diffuser 13 which extends into a second diffuser 14. The first diffuser 13 has a divergent region 21 whose side walls 16 and 17 are adjustable in a flap-like manner, e.g. with the aid of controls represented at 17*a*, for example. In this manner, the opening angle $\gamma$ of the divergent region can be adjusted. The angle $\gamma$ can range between 0.5 and 3° and is preferably 1° or approximately 1°. The angle $\gamma$ is preferably adjustable in a stepless manner. The side walls 16 and 17 can be symmetrical to the median plane M' between them.

At the inlet to the second diffuser 14 a gap 15 open to ambient air is provided between the outlet of the diffuser 13 and the inlet to diffuser 14. A venturi action within the diffuser 14 draws ambient air into the diffuser 14 through the gap 15. The width of the gap 15 is adjustable either by varying the positions of the walls 16 and 17 or by shifting the diffuser 14 vertically as represented by the arrow 14*a*.

The gap 15 can be so set or adjusted that a tangential flow of the secondary air entering through the gap 15 can occur.

The distance $S_2$ between the median plane M' and each side wall 16, 17, can amount to 0.8 $S_1$ to 2.5 $S_1$, where $S_1$ corresponds to the spacing of the narrowest portion of the diffuser 13 from the median plane.

The spacing $S_3$ between the walls of the diffuser 14 at their narrowest portions and the median plane can amount to 0.5 $S_2$ to 2 $S_2$ in a preferred embodiment of the invention.

The distance $S_4$ of the lower edges of the walls of diffuser 14 from the median plane M' should amount to 1 $S_2$ to 10 $S_2$. The angle $\delta$, representing the opening angle of the second diffuser, is preferably also adjustable, e.g. via a controller 14*b*.

The length $L_2$ between the narrowest point of the diffuser 14 and the lower edge of the diffuser 13, while adjustable, can assume a flow between 1 $S_2$ to 15 $S_2$.

The apparatus from the cooling chamber 2, the intermediate passage 2, the stretching unit 4 and the depositing unit 6, disregarding the air drawn in via the gap 15, can form a closed system for recirculation of the process air.

FIG. 5 shows that a single blower 11*b* driven by a motor 11*c* having a speed controller 11*d* can evacuate the suction zones 10, 11 and 12 through respective valves 10*a*, 11*a* and 12*a* which represent throttles controlling the suction speeds in these zones.

We claim:

1. An apparatus for the continuous production of a spun-bond web, comprising:

a spinneret for producing a multiplicity of descending thermoplastic synthetic resin filaments;

a device below said spinneret and receiving said multiplicity of descending thermoplastic synthetic resin filaments for aerodynamically stretching same;

a continuously movable collecting foraminous belt displaceable longitudinally in a web-producing direction below said device for receiving said filaments to produce a spun-bond web therefrom; and three mutually independently controllable suction zones beneath said belt for drawing air therethrough and in succession in said direction, including a primary suction zone at which a greater part of the filaments are drawn onto said belt a first suction zone upstream of said primary suction zone, and a second suction zone downstream of said primary suction zone, said suction zones having suction speeds which are settable independently of one another, said first zone being separated from said primary zone by a first wall, said second zone being separated from said primary zone by a second wall, said first and second walls being so shaped as to form a nozzle contour with a constriction between them, a spacing between said walls at said constriction being adjustable.

2. The apparatus defined in claim 1 wherein the suction speed in said primary zone is settable at a higher level than suction speeds in the other zones.

3. The apparatus defined in claim 2 wherein the suction speed in at least one of said other zones is between 1 and 6 m/s.

4. The apparatus defined in claim 3 wherein the suction speed in at least one of said other zones is between 2 and 5 m/s.

5. The apparatus defined in claim 2 wherein the suction speed in said primary zone is between 25 and 35 m/s.

6. The apparatus defined in claim 5 wherein the suction speed in said primary zone is between 27 and 33 m/s.

7. An apparatus for the continuous production of a spun-bond web, comprising:

a spinneret for producing a multiplicity of descending thermoplastic synthetic resin filaments;

a device below said spinneret and receiving said multiplicity of descending thermoplastic synthetic resin filaments for aerodynamically stretching same;

a continuously movable collecting foraminous belt displaceable longitudinally in a web-producing direction below said device for receiving said filaments to produce a spun-bond web therefrom; and three mutually independently controllable suction zones beneath said belt for drawing air therethrough and in succession in said direction, including a primary suction zone at which a greater part of the filaments are drawn onto said belt and at least one other suction zone, a first suction zone upstream of said primary suction zone, and a second suction zone downstream of said primary suction zone, said suction zones having suction speeds which are settable independently of one another, the suction speed in said primary zone being settable at a higher level than suction speeds in the other zones, at least a third of the length $1_2$ of said second suction zone in said direction lies upstream of a pair of pressing rolls between which said belt entrains the spun-bond web.

8. The apparatus defined in claim 2 wherein a single suction blower is provided for all of said zones and that respective suction conditions are created in said zones by respective suction-setting elements.

9. The apparatus defined in claim 8 wherein said suction-setting elements are throttling elements.

10. The apparatus defined in claim 1 wherein a spacing between said walls above said constriction is adjustable.

11. The apparatus defined in claim 10, further comprising a nozzle below said device and formed with at least one diffuser above said belt.

* * * * *